US011015477B2

(12) United States Patent
Lagarde et al.

(10) Patent No.: US 11,015,477 B2
(45) Date of Patent: May 25, 2021

(54) ASSEMBLY FOR CONTROLLING VARIABLE PITCH BLADES

(71) Applicant: Safran Aircraft Engines, Paris (FR)

(72) Inventors: Romain Nicolas Lagarde, Moissy-Cramayel (FR); Lilian Yann Dumas, Moissy-Cramayel (FR)

(73) Assignee: Safran Aircraft Engines, Paris (FR)

( * ) Notice: Subject to any disclaimer, the term of this patent is extended or adjusted under 35 U.S.C. 154(b) by 47 days.

(21) Appl. No.: 16/448,680

(22) Filed: Jun. 21, 2019

(65) Prior Publication Data

US 2019/0390563 A1 Dec. 26, 2019

(30) Foreign Application Priority Data

Jun. 22, 2018 (FR) ..... 1855604

(51) Int. Cl.

| | |
|---|---|
| ***F01D 17/16*** | (2006.01) |
| ***F01D 9/04*** | (2006.01) |
| ***F01D 17/26*** | (2006.01) |
| ***F01D 25/24*** | (2006.01) |

(52) U.S. Cl.

CPC ..... *F01D 17/162* (2013.01); *F01D 9/041* (2013.01); *F01D 17/26* (2013.01); *F01D 25/24* (2013.01); *F05D 2220/323* (2013.01); *F05D 2260/50* (2013.01)

(58) Field of Classification Search

None

See application file for complete search history.

(56) References Cited

U.S. PATENT DOCUMENTS

| | | | | |
|---|---|---|---|---|
| 2,823,700 | A * | 2/1958 | Christensen | F01D 17/162 138/46 |
| 3,549,272 | A * | 12/1970 | Bouiller | F01D 5/022 416/166 |
| 5,549,448 | A | 8/1996 | Langston | |
| 10,502,087 | B2 * | 12/2019 | Benderradji | F01D 17/141 |
| 2018/0016931 | A1 | 1/2018 | Benderradji et al. | |
| 2018/0017080 | A1 | 1/2018 | Walters | |

FOREIGN PATENT DOCUMENTS

| | | | |
|---|---|---|---|
| FR | 2982653 | A1 | 5/2013 |
| FR | 3054006 | A1 | 1/2018 |
| GB | 1 071 108 | A | 6/1967 |

* cited by examiner

*Primary Examiner* — Michael Lebentritt
*Assistant Examiner* — Jason G Davis
(74) *Attorney, Agent, or Firm* — Blank Rome LLP

(57) ABSTRACT

An assembly for the control of variable pitch blades. The assembly includes a movable part movable parallel to an axis is in engagement with pivot connections which rotate about at least one radial axis fixed with respect to the casing, and which act on a radial shaft, which passes through a clevis fixed with a control ring to rotate with it about said axis. The radial shaft is mounted radially rotating with respect to the control ring and the casing.

10 Claims, 5 Drawing Sheets

ASSEMBLY FOR CONTROLLING VARIABLE PITCH BLADES

This application claims priority to French patent application no. 1855604, filed Jun. 22, 2018, the entirety of which is incorporated by reference herein.

TECHNICAL FIELD

Embodiments described herein relate to an assembly for controlling variable pitch blades in an aircraft gas turbo-engine, and to a turbo-engine comprising such an assembly.

BACKGROUND

Conventionally, an assembly for variable pitch blades comprises a shroud in which the blades are mounted for rotation around their own axis, wherein the orientation of the blades is known as the pitch. To control the pitch of the blades, it is known to use an control ring coaxial to the shroud around a longitudinal axis of the turbo-engine and connected to the pivot of each of the blades by rods integral with said blade pivots. The control ring is connected to the pivot of each of the blades by rods attached to the blade pivots. A driving device rotates the ring, around the shroud, which pivots the rods around their respective pivots, thereby allowing an angular pitch of the blades in relation to the flow of air circulating inside the shroud. Owing to the rigidity of the rods, the movement of the ring corresponds to the combination of rotation around the longitudinal axis, induced by the driving device and translation along the same longitudinal axis.

Thus, for example FR3054006 discloses such an assembly including:

at least one control ring:
- surrounding a turbo-engine casing arranged about said turbo-engine axis (X), and
- connected by connecting rods to the variable pitch blades, which rotate about a radial axis to said axis (X), and a device for controlling the actuating ring, rotating about said axis (X) and translating parallel to this axis (X).

In FR3054006, the objectives are to reduce the dimensions of the components to produce a turbo-engine with the least possible impact on aerodynamic drag, and to limit maintenance, since the parts of the driving device are moving parts that wear over time.

These goals are also addressed here. In addition, it is desirable to reduce the complexity of previous solutions and make the general blade control more compact, without necessarily using a driving device mounted tangentially between a so-called control ring and a casing surrounding the blades. Mounted in a rotating manner, this active actuator, in this case a cylinder, imposes on the control ring, when actuated, a rotational movement about the aforementioned X axis, which tends to generate an axial deflection of the ring, i.e. a torsion of the part of the ring opposite to the actuator, about a radial axis. This deflection must be prevented at all costs, since it results in greater displacement of the rods of the blades located in this portion, resulting in a different angular pitch for the vanes.

In this text:

active means that the element concerned (actuator, cylinder . . . ) is controlled or actuated, as opposed to passive. It is from this point that the blade timing is induced by the application of the "aerodynamic laws" in force, which define the position of the moving part of the said element, "axial" means parallel to the above-mentioned axis of rotation X, the term "radial" means perpendicular to the axis X about which, for example, the turbine blades rotate, circumferential means extending about the axis X, "outer" and "inner" (or "external" and "internal") respectively mean radially outer and radially inner, and "upstream" and "downstream" are axial positions with reference to the general direction of movement of the gas in the turbo-engine.

However efficient it may be, the FR3054006 solution can be improved in terms of control accuracy, area(s) of assembly of the control ring(s) control device and minimization of parts (number, sizes, overall compactness), because during operation of the engine (of the turbo-engine), the latter deform (the term "hysteresis" is often used), causing calibration errors when applying said "aerodynamic laws".

In order in particular to provide a simple, effective and economical solution to at least some of these problems, embodiments of the invention propose that the above-mentioned device for controlling at least one of the control ring(s) should include an active actuator, which is a cylinder, having:

a fixed part (30*a*) fixed to the casing, and a mobile part (30*b*) movable parallel to said axis (X), grooved, via a grooved rod, and engaged with pivot connections:
- which rotate between them about at least one radial axis fixed with respect to the casing,
- and which act on a radial shaft passing through a clevis fixed with the control ring to rotate with it about said axis (X), the radial shaft being mounted radially rotatable with respect to the control ring and the casing, so that a movement of the actuator parallel to said axis (X) acts on the blade pitch, by:

actuating the pivot connections, rotation of said radial shaft, rotation of said rods, and rotation of the control ring.

Thus, it is possible to avoid the presence of a VSV box (anti-pumping device controlling the variation of the pitch of the compressor blades), and a control rod. And such a mobile actuator part allows to deepen the designs of VSV kinematics.

According to another characteristic, it is proposed that the moving part of the actuator should have a succession of so-called grooves, perpendicular to the axis (X) of the turbo-engine.

Thus, as a movable actuator rod, a rod with a succession of grooves may be preferred over a rod with a single helical groove, which may be less precise in this case.

In addition, it may be proposed that the pivot connections with which (one of the connections from which) the moving part is in gear engagement include a secondary link with a toothed sector head meshing with the grooves of the moving part.

Indeed, one of the elements of the pivot connections may then have a toothed surface that meshes with the grooved area of the actuator. Such a connection is reliable, easy to control in maintenance and is particularly suitable in a solution with a succession of parallel grooves between them.

For precise control return between the moving part of the actuator and the radial shaft, it is recommended that the pivot connections include (at least) two secondary connecting rods articulated to each other about a said radial axis fixed with respect to the casing. One of these connecting rods may be fixedly connected to the said radial shaft.

It is also proposed that said assembly further includes:

a first rigid casing that will surround the moving part of the actuator, and lubricant contained in said first casing.

Thus, lubrication and protection will be combined.

Preferably:

the lubricant will lubricate the assembly in engagement of the pivot connections with the moving part of the actuator, and said assembly shall further comprise at least a second protective casing which shall surround said lubricated assembly, the second casing containing a sealing bellows which shall isolate said lubricated assembly from the outside.

This will allow for sealed lubrication, which will ensure efficiency in the transmission of movement, reliability and limitation of grease or oil passage into unsuitable areas.

On the turbo-engine, which will present all or part of the characteristics of the above-mentioned assembly, it will also be possible to provide:

that the casing surrounded by said at least one control ring is a high-pressure casing that will surround a high-pressure compressor of the turbo-engine, that the turbo-engine further comprises an intermediate casing arranged adjacent upstream to the high-pressure casing to which it is coaxially attached, and that the fixed part of the actuator is fixed to an external surface of the intermediate casing.

In this way, it will be possible to attach a welded part to the intermediate casing in order to associate with it the above-mentioned VSV kinematics, thus with:—fixing the fixed part of the actuator there, and a low expansion, because the temperature of the intermediate casing is significantly lower than that of the high-pressure casing.

In addition, the fixed part of the actuator may be fixed to said outer surface of the intermediate casing through said first rigid casing which will then be fixed at its axial ends on one side to said fixed part of the actuator and on the opposite side to said outer surface of the intermediate casing.

This will combine compactness, mechanical efficiency and protection of the control interface between the actuator and the pivot connections.

The invention will be better understood, if need be, and other details, characteristics and advantages of the invention will appear upon reading the following description given by way of a non restrictive example while referring to the appended drawings wherein:

BRIEF DESCRIPTION OF THE FIGURES

FIG. 4 is a detailed view in perspective from above (outside) of an assembly according to an exemplary embodiment of the invention mounted on a turbo-engine part;

DETAILED DESCRIPTION

Figure 1:
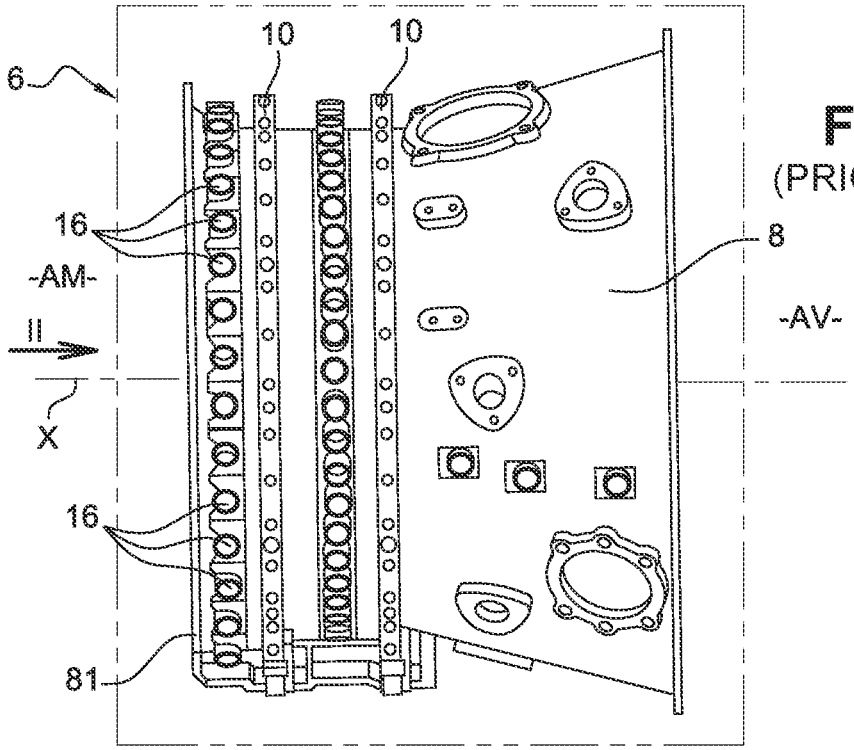
Fig. 1 (PRIOR ART)
FIG. 1 is a side view of a part of a turbo-engine comprising a casing on which rings for controlling variable pitch blades are mounted.
Figure 2:
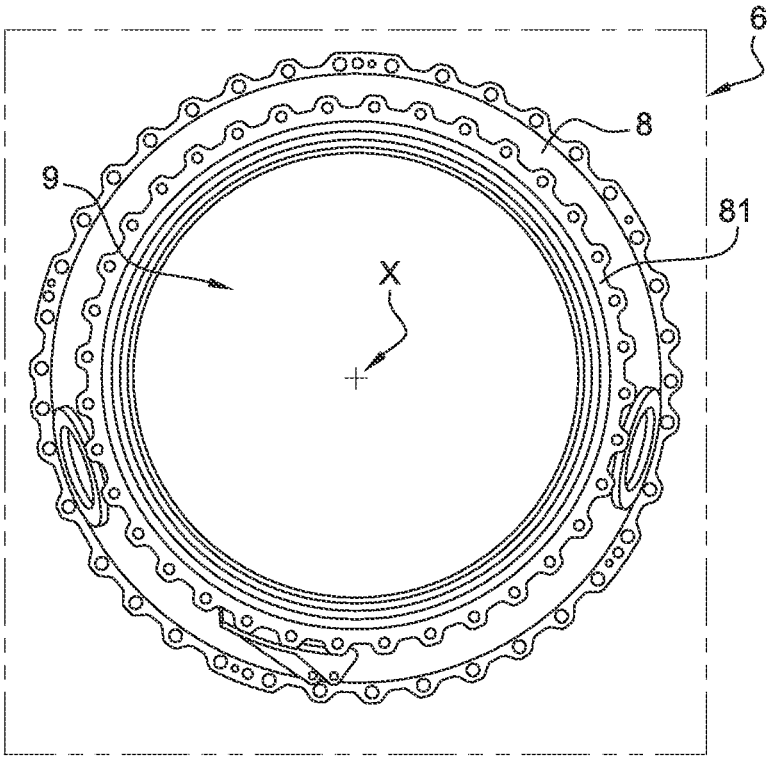
Fig. 2 (PRIOR ART)
FIG. 2 is a front view of said part of a turbo-engine of FIG. 1 (arrow II)

Illustrated in the figures is an assembly 2, particularly for controlling variable pitch blades 4 in a turbo-engine 6, comprising a casing 8 of the turbo-engine 6, at least one control ring 10 surrounding the casing 8 and connected by rods 12 to the variable pitch blades 4 and a driving device 14 for rotating the control ring(s) 10 around the casing 8. Preferably, casing 8 is annular and has a longitudinal X axis that is coaxial with the general longitudinal axis of the turbo-engine, which is the axis around which the rotor of the turbo-engine rotates. The control ring 10 is coaxial with and mounted around the casing 8.

Casing 8 can be the HP (high pressure) casing; or the casing surrounding the high pressure compressor 9 located axially upstream of the combustion chamber, arranged like the others along the X axis. For example, on a dual-flow turbojet engine, as a turbo-engine, the flow from a front (or upstream) fan rotor is separated into two concentric flows, primary and secondary. The primary flow is guided toward the turbo-engine, which in particular drives the blower rotor. The secondary flow is either released directly into the atmosphere by providing an essential part of the thrust, or mixed downstream of the turbine with the hot primary flow before ejection.

The turbo-engine includes additional compressor stages (HP compressor), a combustion section and several turbine stages, the last of which (low-pressure turbine) drives the blower.

The equipment used to operate the engine is controlled, powered or in communication with the outside of the engine by a set of cables, transmission shafts and pipes generally known as easements.

The easements are generally partly housed in the structural arms of a said intermediate casing for the radial passage of the primary and secondary flows. The intermediate casing is thus a wheel-shaped stator element with a hub part and a cylindrical outer shell, communicating with a drive casing for auxiliary machines, better known by its abbreviation AGB. These two elements are connected by a plurality of radial structural arms.

In the example shown in the Figures, and in particular in FIG. 1, the casing 8 is equipped with two rings 10. However, only one ring 10 will often be mentioned in the following description, it being understood that all control rings 10 are identical and operate in the same way.

Casing 8 has radial stacks 16 in which nuts 18 are fixed radially to the blades 4. The blades 4 extend radially around the X axis. Each nut 18 defines a radial axis 12*a* for rotating the blade 4. Thus the nuts 18 drive the angular pitch of the blades 4 around axes 12*a*. The connecting rods 12 are integral at a first end with the nuts 18 of the blades 4 and at a second end with the control ring(s) 10. The connection between the connecting rods 12 and the control ring 10 is a ball joint allowing a rotational movement between each connecting rod 12 and the control ring 10, about a radial axis to the axis 12*a* of rotation of the nut 18 to which the connecting rod 12 is also connected.

Hence, when the control ring 10 is driven in rotation by the driving device 14, the rods 12 pivot relative to the ring and are forced by their second end to follow the control ring 10, in such a way that as a result of their solid attachment to the nuts 18 of the blades 4, the movement of the rods 12 implies the rotation of the blades 4 around their respective axis 12*a*.

Figure 3:
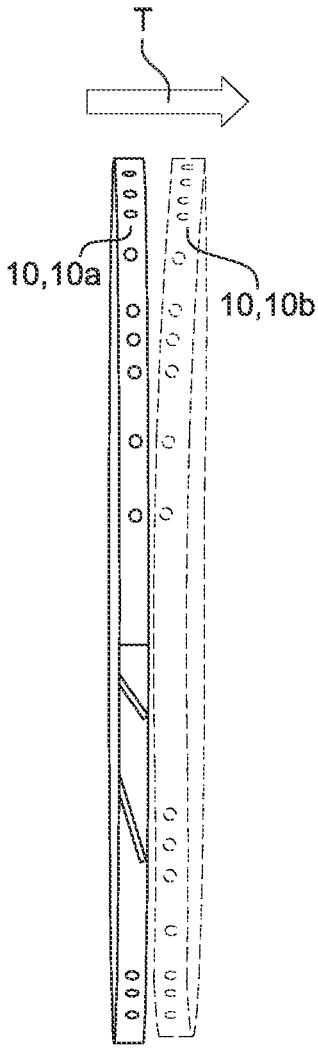
Fig. 3 (PRIOR ART)
FIG. 3 is a side view showing a ring during normal movement and, in dotted lines, a ring having undergone deflection, FIGS. 1 to 3 referring to the prior art.

To control/actuate (preferably together) the control rings 10 (as in the example, two rings 10*a*, 10*b*, respectively upstream and downstream; FIG. 3 in particular), the assembly 2 therefore includes a control device 14 which is single or double, or else includes twice the device 14, each arranged diametrically opposite each other about the axis X.

The (each) control device 14 includes an active actuator 30 acting, via pivot connections 33 (also called horns) on the rotation, about the axis X, of at least one said control rings 10 and on the angular setting of the blades 4 about their respective radial axes 12*a*. For this purpose, the actuator 30 comprises a fixed part 30*a* with respect to the casing 8 and a movable part 30*b* movable parallel to said axis X and in engagement with the pivot connections 33 (see in particular FIGS. 4 and 5).

Figure 6:
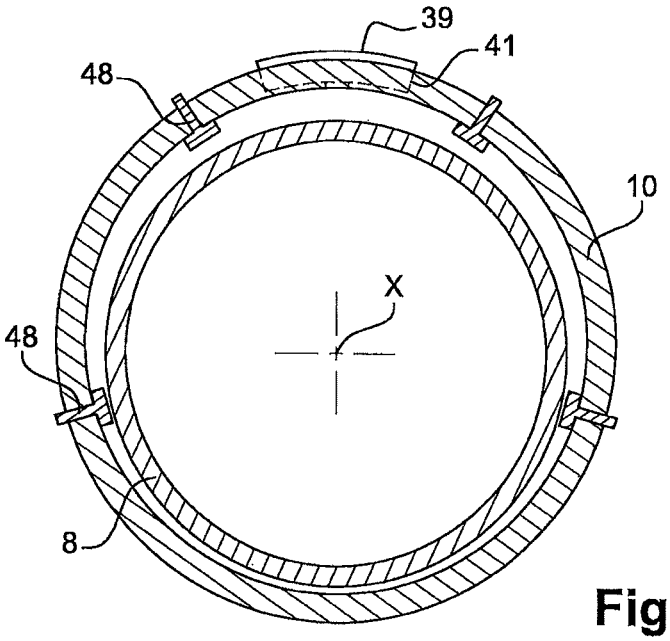
FIG. 6 is a simplified diagram, in cross-section according to line VI-VI, of a control ring for the above-mentioned assembly.
Figure 8:
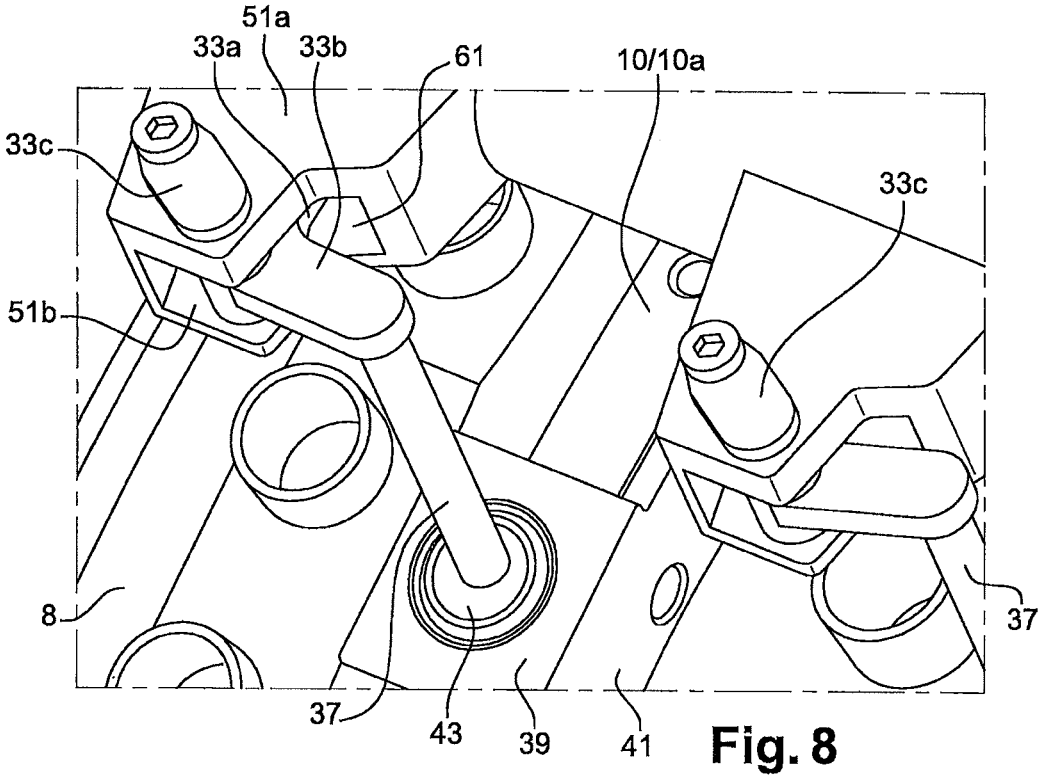
FIG. 8 is a detailed view comparable to that of FIG. 4, from a different (external) angle.
Figure 9:
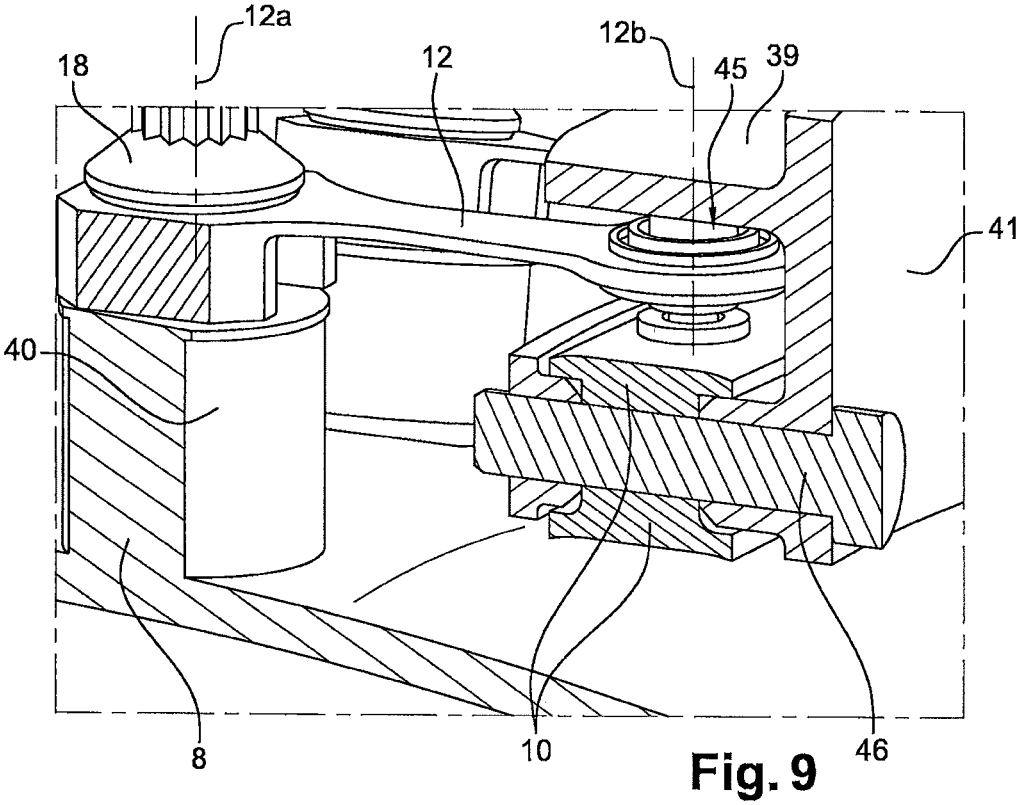
FIG. 9 is a cross-sectional view according to line IX-IX, assuming that the observer is circumferentially offset by two rows of stacks upwards, thus almost circumferentially adjacent to the section according to line VII-VII.
Figure 10:
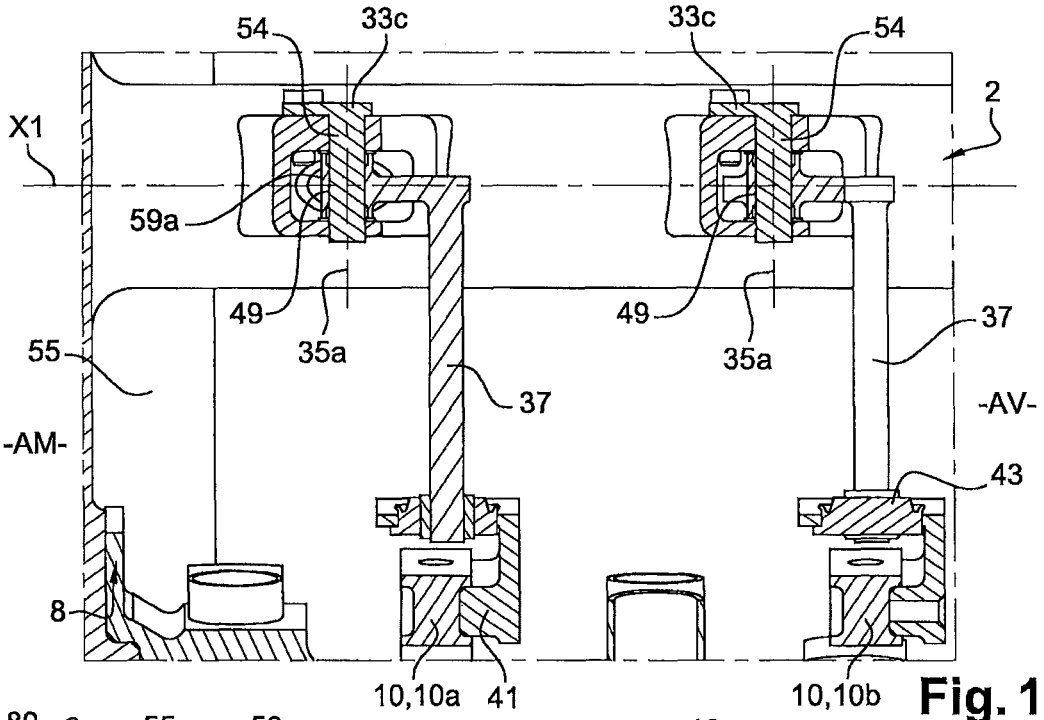
FIG. 10 is a cross-sectional view along line X-X.

The pivot connections 33 rotate around radial axes, in particular 35*a*, fixed with respect to the casing 8. By pivoting about these radial axes, the pivot connections 33 act on a radial shaft 37 passing through a clevis 39 of a support 41 fixed to (fixed with) the control ring 10. A seal 43 is placed between the radial shaft 37 and the clevis 39 (see FIGS. 8 and 10 in particular). The radial shaft 37 is mounted radially rotating with respect to the control ring 10 and therefore to the casing 8. Each support 41 forms a sector around casing 8. FIG. 9 shows a possible axial fixing (here by screws 46) between said support 41 and said control ring 10. And FIG. 6 (showing only one support 41) allows the skids 48 to be seen circumferentially.

For the control of each control ring 10, each rod 12 of the respective circumferential rod line is axially pivoted along radial axes 12*a*, 12*b* between a radial blade 4 to be pitched, here upstream (via one of the nuts 18) and there downstream, a radial connection 45 fixed to the respective control ring 10.

Figure 7:
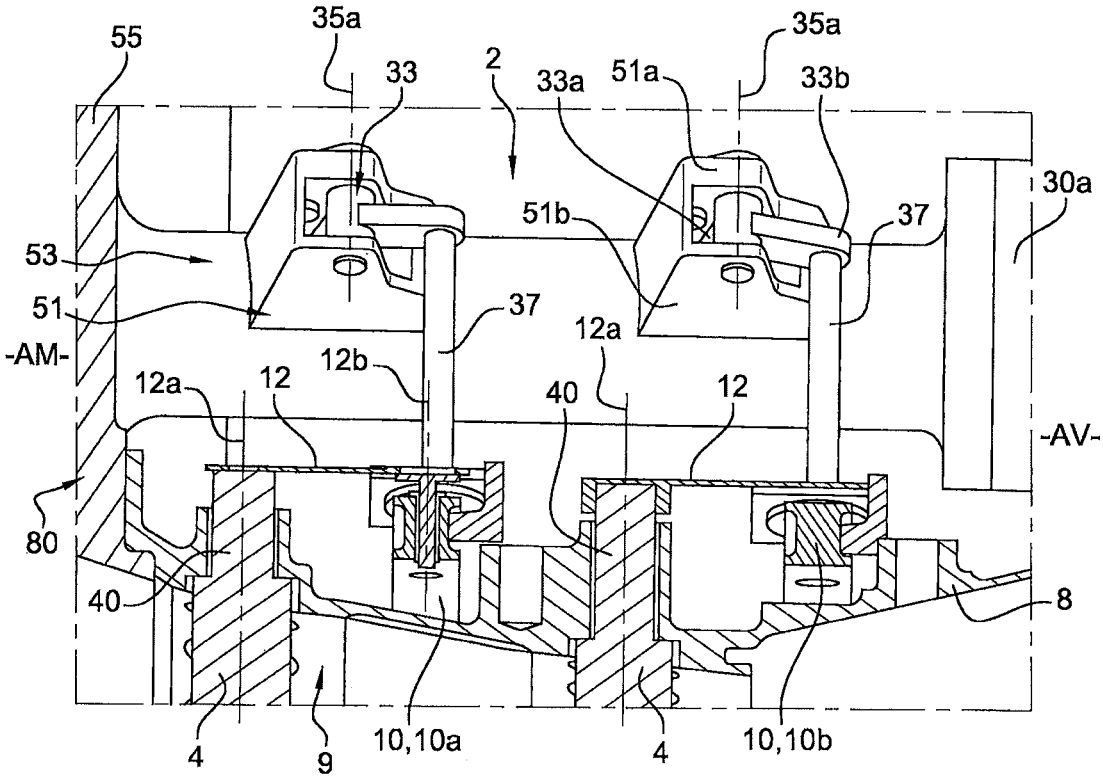
FIG. 7 is a simplified diagram, in cross-section according to line VII-VII, in particular of said connecting rods 12 which must be assumed to exist in the stacks 16 upstream and downstream to where the cross-section passes.

Since the radial blades 4 to be pitched are housed under the casing 8, radial extensions 40 of these blades 4 pass through the casing, along said radial axes 12*a*, to be pivotally connected to the relevant connecting rods 12 (see FIGS. 7 and 9).

Thus, any controlled movement of the actuator 30 parallel to the axis X (axis X1, FIGS. 11-12; double arrows) will act on the angular setting of the blades 4, by actuating the pivot connections 33, rotation of the said (each) radial shaft 37, rotation of the connecting rods 12 and rotation of the (each) control ring 10 which will therefore rotate around the axis X. The movement of the control ring 10, when the blades 4 are set, is therefore a combination of a rotation about the longitudinal axis X, induced by the actuator 30, and a translation T (along the same longitudinal axis X) imposed by the non-deformable connecting rods 12.

The pivot connections 33 include rods 33*a*, 33*b* and even 33*c* (called secondary to differentiate them from rods 12) arranged tangentially (on the X axis). Thus, it is by pivoting these secondary rods around their radial axes of rotation that the blades will be pitch controlled around their respective axes 12*a*. In the example, said secondary connections 33 (or, individually, the different groups of these connections) comprise (at least) two secondary connecting rods 33*a*,33*b* with variable relative angular position about their common radial axis of rotation 35*a*. The radial pivot 49 of the rod 33*a* extending along this axis 35*a* is fixedly mounted, except in radial rotation, between two walls, respectively upper and lower, 51*a*,51*b*, of a transverse protrusion 51 (structural, rigid) fixed with a casing (structural, rigid) 53 inside which the movable part 30*b* of actuator 30 passes axially. Axially, a first end of the casing 53 is fixed to said fixed part 30*a*; at the opposite end, the casing 53 is fixed to an annular radial web 55 of the intermediate casing 80 forming an outer surface of this casing. The intermediate casing 80 is located upstream of the casing 8 which is axially adjacent to it and to which it is fixed by screwing, at the location of the flange 81 of the casing 8. Thus, with respect to the fixed part 30*a*, the moving part 30*b* is oriented upstream; see FIGS. 10-12 in particular.

By fixing the actuator 30 to the intermediate casing 80 in this way, the thermal stresses on the actuator are limited. In this regard, it should be recalled that, on a turbojet engine, is typically found, from upstream to downstream, the fan casing (which contains the fan and the low-pressure compressor), the intermediate casing 80, the casing 8 of the high-pressure compressor, then the diffuser and combustion chamber casing.

The radial pivot 54 of another rod 33*c*, which is fixed with the upper wall 51*a*, passes through the pivot 49 along the radial axis 35*a*.

The secondary connecting rod 33*a* also has a head with a gearwheel sector 38 which meshes with a grooved rod 42 included on the actuator 30, as control rod for its moving part 30*b*.

As an active element, the actuator 30 will favourably be a cylinder that can be hydraulic.

In addition, to secure the control, the movable part 30*b* of the actuator will be favourably movable exclusively in translation (axis X1) and will have a succession of grooves 60 perpendicular to said axis X. The grooves 60 are also parallel to each other, which is favourable for gear cooperation with pivot connections 33 (gear Wheel 38).

Figure 4:
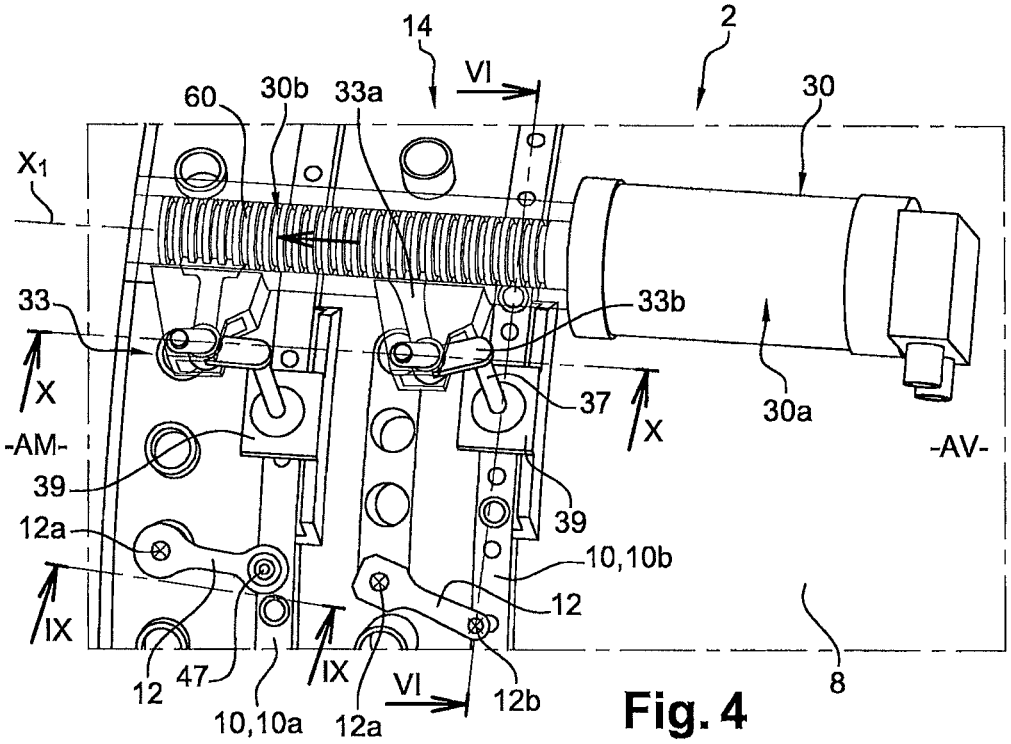
FIG. 4 and following do not include all the parts intended for the operation of the blade control assembly shown here, for example (the references are those specified below), are not shown, on the 16 radial stacks, all the nuts 18 radially attached to the blades 4, nor the rods 12 through which they pass; for example, only a few rods are shown; thus.
Figure 5:
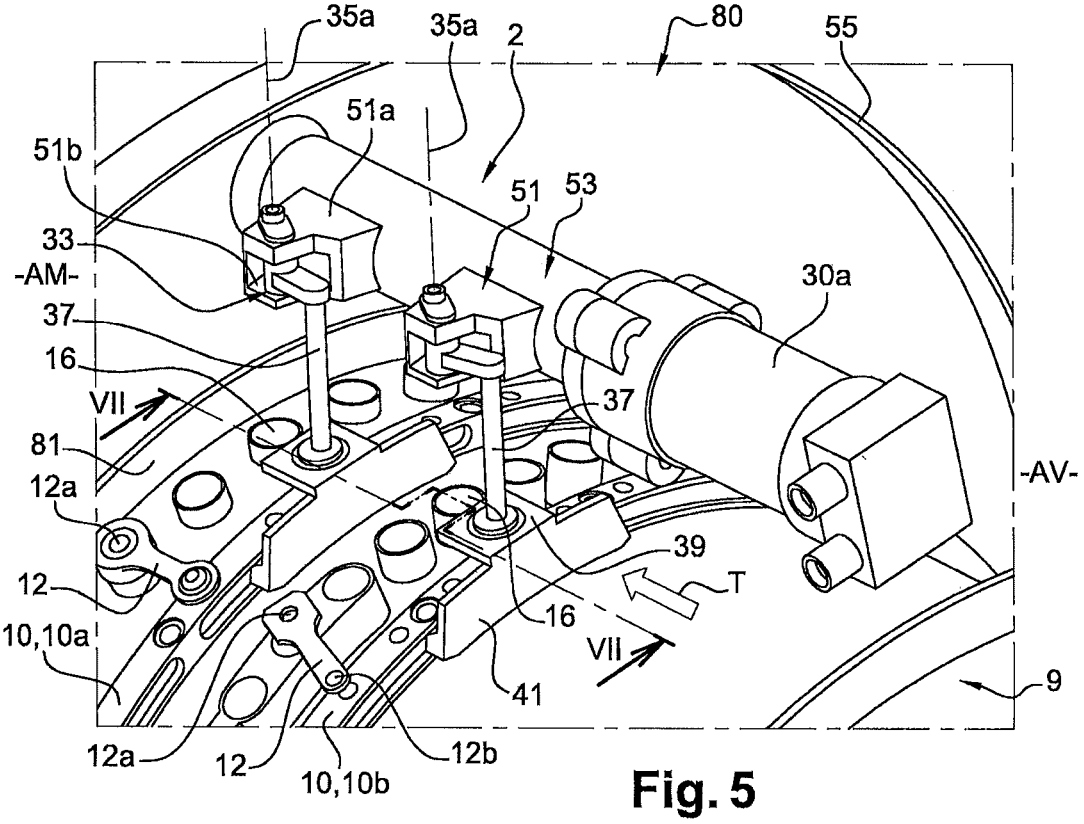
FIG. 5 is a similar view to that of FIG. 4, from a different (external) angle.
Figure 11:
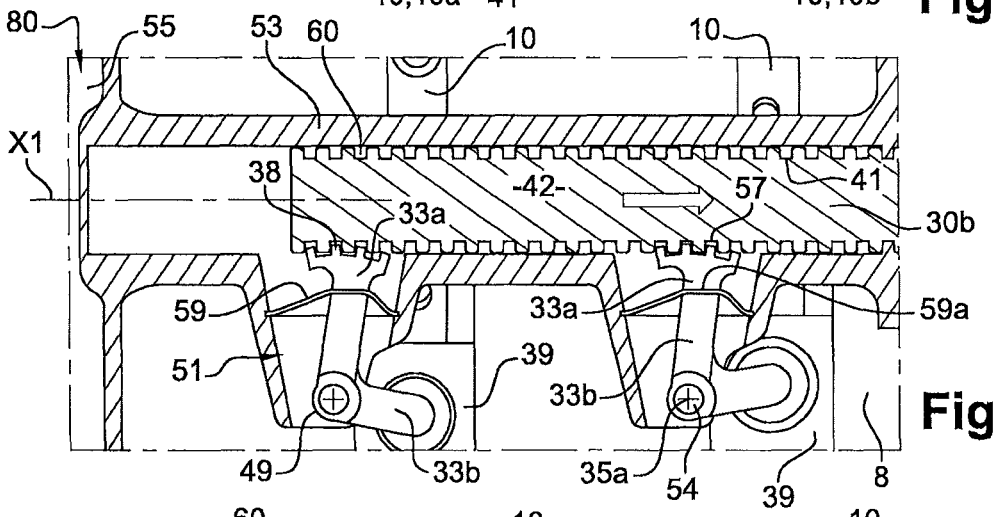
FIGS. 11, 12 show two different positions of the connection between the moving part 30*b* of the actuator 30 and the pivot connections 33 in engagement with it, along a cross-section in the horizontal plane P passing through axis X1 (FIG. 10).
Figure 12:
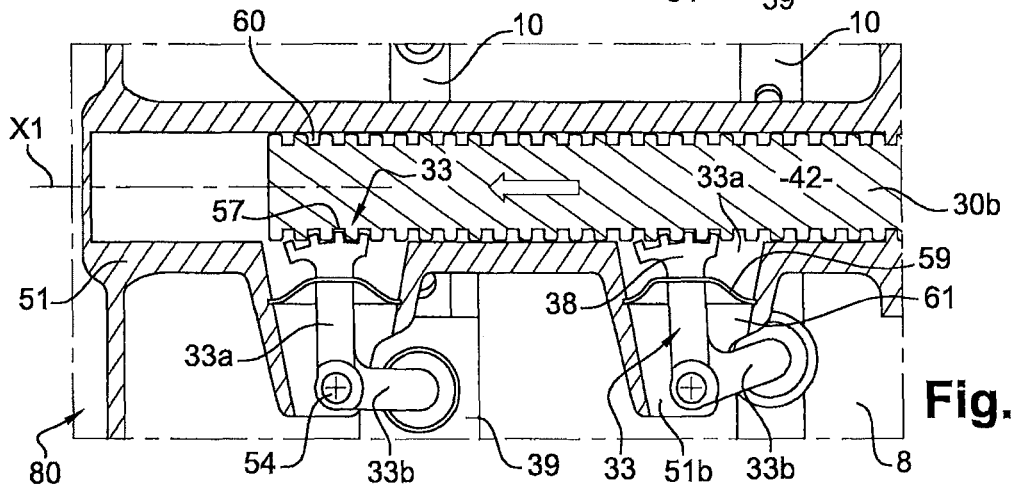

It is between grooves 60 of the moving part 30*b* and a gearwheel sector (38 mentioned above in the example) on one of the pivot connections that the gear engagement connection between this moving part and the pivot connections 33 will therefore be favourably achieved; see FIGS. 4, 11, 12 in particular.

A sealed lubrication of this connection between the moving part 30*b* and the pivot connections 33 can also be provided.

Thus, lubricant 57 will be able to lubricate this intermediate zone between the above-mentioned structural elements 53, 51, which respectively form a first and a second protective casing communicating one with the other. A flexible sealing bellows 59 can be mounted around the rod 33*a*, fitted into a said second casing (rigid transverse protrusion 51). An axial slot 59*a* in the bellows 59 will allow the pivoting of the pivot connections, without any particular grease leakage. Another downstream slot 61 between the walls 51*a*, 51*b* of the protrusion 51 also allows this free pivoting; see FIGS. 8 and 12 in particular.

The invention claimed is:

1. An assembly for controlling variable pitch blades in a turbo-engine of an aircraft, the assembly comprising:

a control ring:

surrounding a casing of the turbo-engine arranged about a longitudinal axis of the turbo-engine, and connected by connecting rods to the variable pitch blades, which each pivot about a first radial axis which is radial to said longitudinal axis, and a device for driving the control ring, rotating about said longitudinal axis and translating parallel to said longitudinal axis, wherein the device for driving the control ring comprises an actuator having:

a fixed part fixed to the casing, and a movable part movable parallel to said longitudinal axis, grooved, via a grooved rod, and in engagement with pivot connections:

which each rotates about a respective second radial axis fixed with respect to the casing and radial to said longitudinal axis, and which each acts on a radial shaft, which radial shaft passes through a clevis fixed with the control ring to rotate with the control ring about said longitudinal axis, the second radial shaft being mounted radially rotatable with respect to the control ring and the casing, so that a movement of the actuator parallel to said longitudinal axis acts on the pitch of the blades, by actuating the pivot connections, rotation of the radial shafts, rotation of the connecting rods, rotation of the control ring.

2. The assembly according to claim 1, wherein the movable part of the actuator is movable exclusively in translation and has a succession of said grooves perpendicular to said longitudinal axis.

3. The assembly according to claim 1, wherein the movable part is in gear engagement with the pivot connections.

4. The assembly according to claim 3, wherein the pivot connections with which the movable part of the actuator is in gear engagement respectively comprise a secondary connection having a toothed sector head meshing with the grooves of the movable part.

5. The assembly according to claim 1, wherein the pivot connections respectively comprise at least two secondary connecting rods articulated to each other about said respective second radial axis fixed with respect to the casing.

6. The assembly according to claim 1, further including:

a first rigid casing surrounding the movable part of the actuator, and a lubricant contained in said first rigid casing.

7. The assembly according to claim 6, wherein:

the lubricant lubricates the engagement of the pivot connections with the moving part of the actuator, and said assembly further comprises at least a second protective casing surrounding said engagement and interposed between said engagement and an external environment, the second protective casing containing a sealing bellows that insulates said engagement from the external environment.

8. A turbo-engine comprising the assembly according to claim 1, wherein:

the casing surrounded by said at least one control ring is a high pressure casing which surrounds a high pressure compressor of the turbo-engine, the turbo-engine further comprises an intermediate casing arranged adjacent to the high-pressure casing to which the intermediate casing is coaxially attached, and the fixed part of the actuator is fixed to an outer surface of the intermediate casing.

9. The turbo-engine according to claim 8, wherein:

the turbo-engine further comprises a first rigid casing surrounding the movable part of the actuator, and a lubricant contained in said first rigid casing, and the fixed part of the actuator is fixed to said outer surface of the intermediate casing through said first rigid casing which has axial ends where the first rigid casing is fixed respectively to said fixed portion of the actuator and to said outer surface of the intermediate casing.

10. The assembly according to claim 1, wherein the actuator is an active actuator, which includes a cylinder.

* * * * *